US005940106A

United States Patent [19]

Walker

[11] Patent Number: 5,940,106

[45] Date of Patent: Aug. 17, 1999

[54] RESISTIVE MEDIA SIZE SENSING SYSTEM

[75] Inventor: Steven H. Walker, Camas, Wash.

[73] Assignee: Hewlett-Packard Company, Palo Alto, Calif.

[21] Appl. No.: 08/794,253

[22] Filed: Jan. 31, 1997

[51] Int. Cl.[6] ..... B41J 2/01; B41J 13/26

[52] U.S. Cl. ..... 347/104; 271/171; 338/176; 399/389; 399/45; 400/708; 347/16

[58] Field of Search ..... 347/104, 16; 399/389, 399/45; 400/708, 708.1; 271/171, 265.02; 338/176; 33/712

[56] References Cited

U.S. PATENT DOCUMENTS

| | | | |
|---|---|---|---|
| 3,457,537 | 7/1969 | Hines | 338/162 |
| 4,430,635 | 2/1984 | Sacchetti | 338/176 |
| 4,435,691 | 3/1984 | Ginn | 338/176 X |
| 5,023,728 | 6/1991 | Nimura | 347/16 X |
| 5,332,208 | 7/1994 | Tsuji et al. | 271/171 |
| 5,483,889 | 1/1996 | Hoberock et al. | 101/232 |
| 5,574,551 | 11/1996 | Kazakoff | 399/45 |
| 5,689,759 | 11/1997 | Isemura | 399/45 |

FOREIGN PATENT DOCUMENTS

| | | |
|---|---|---|
| 8026493 | 1/1996 | Japan . |
| 8118758 | 5/1996 | Japan . |
| 8119487 | 5/1996 | Japan . |

*Primary Examiner*—Joseph Hartary
*Attorney, Agent, or Firm*—Flory L. Martin

[57] ABSTRACT

A resistive sensing system is provided for determining the size of print media which has been loaded into an input member inkjet printing mechanism for printing. The media is typically has length and width dimensions, and the printing mechanism has sliding length and width size adjusters which are pushed into contact with the media edges to secure the media in the input member for printing. The length and width size adjusters each have sliding contacts which engage an energized conductive strip at a location corresponding to the position of the size adjusters. The printing mechanism has a controller that interprets an electrical signal received from the sliding contacts to determine what size of media is loaded in the printing mechanism. An inkjet printing mechanism having such a resistive media size sensing system is also provided, along with a method of determining the size of media loaded into the printing mechanism.

22 Claims, 7 Drawing Sheets

RESISTIVE MEDIA SIZE SENSING SYSTEM

FIELD OF THE INVENTION

The present invention relates generally to inkjet printing mechanisms, and more particularly to a system for sensing the size of print media which has been loaded for printing.

BACKGROUND OF THE INVENTION

Inkjet printing mechanisms use cartridges, often called "pens," which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. Some caps are also designed to facilitate priming by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To print an image, the printhead is scanned back and forth across a printzone above the sheet, with the pen shooting drops of ink as it moves. By selectively energizing the resistors as the printhead moves across the sheet, the ink is expelled in a pattern on the print media to form a desired image (e.g., picture, chart or text). The nozzles are typically arranged in linear arrays usually located side-by-side on the printhead, parallel to one another, and perpendicular to the scanning direction, with the length of the nozzle arrays defining a print swath or band. That is, if all the nozzles of one array were continually fired as the printhead made one complete traverse through the printzone, a band or swath of ink would appear on the sheet. The width of this band is known as the "swath width" of the pen, the maximum pattern of ink which can be laid down in a single pass. The media is moved through the printzone, typically one swath width at a time, although some print schemes move the media incrementally by for instance, halves or quarters of a swath width for each printhead pass to obtain a shingled drop placement which enhances the appearance of the final image.

An automatic manner of sensing the size of print media which has been loaded at the input of an inkjet printing mechanism is the subject addressed herein. The print media, may be any type of substantially flat material, such as plain paper, specialty paper, card-stock, fabric, transparencies, foils, mylar, etc., but the most common type of medium is paper. For convenience, we will discuss printing on paper as a representative example of these various types of print media. The media may be supplied to the printing mechanism in a variety of different sizes. For instance, in desktop inkjet printers, paper is typically supplied in a stack of cut-sheets, such as letter size, legal size, or A-4 size paper, which are placed in an input tray. Smaller sized envelopes or postcards or other media sizes may also be used for printing. Typically, the media sheets, cards or envelopes are sequentially pulled from the top of the stack and printed on, after which they are deposited in an output tray.

It would be desirable to have an inkjet printing mechanism which can communicate to the host computer what size of media has been loaded into the printing mechanism, particularly when the printing mechanism is not within sight of the computer operator, such as when several computer users on a networked system share a single printer. Even when an inkjet printer is located on the operator's desktop, it may be helpful to provide the operator with a warning if the wrong size media is loaded for a particular print job. This would allow the operator to load the proper size media, or to adjust the print job parameters to fit the size of the loaded media.

Sensing of media length and width is a feature often found in high-end printers and plotters for business and industrial use, where there is less sensitivity to price. Unfortunately, for the small business and home markets, automated media type detection has not been economically viable. The expense of the earlier methods of media sensing precludes their use within the frugal, highly competitive home market segment.

In the past, two basic methods have been used for media size determination. The first method employed a retroflective photo diode attached to the carriage of the printer or plotter. In a reciprocating printing mechanism, the carriage carries the inkjet pens while traversing the width of the media to lay down a swath of ink. As the carriage passed over the edge of the media, the signal received from the retroflective sensor correspondingly shifted due to the change in reflectance seen after passing over the media edge. The printer controller then noted the position of the carriage at which the retroflective sensor signal shifted. As the carriage moved in the opposite direction to the other side of the media, the shift was again detected, with the difference between the carriage positions at these two detection points being used by the printer controller to determine the media width.

The second method of determining the media size functions in a manner similar to the first, except that a capacitive sensor is mounted on the carriage for use as a media edge detector. Resolution of either method varies depending upon the quality and focal distance of the sensor. In general, the retroflective sensor delivers a higher resolution for a lower cost, and is consequently more prevalent. However, the capacitive sensor has the advantage of being more robust when detecting transparent media, such as that used to make overhead projector slides.

Besides width, media length detection has also been performed by plotters using retroflective and capacitive sensors. In these systems, with the printhead carriage positioned over the media, the feed roller is driven forward to move the media underneath the carriage-mounted sensor. When the leading edge of the media is detected, the position of the media drive roller is noted. The media is then driven on until the trailing edge of the media is detected, again noting the position of the drive roller. The difference between these two positions is used by the printer controller to calculate the media length.

Unfortunately, this technique of media length detection is used only with plotters, because most inkjet printers are limited to driving media unidirectionally, that is, only forward through the print zone. One exception to this rule of forward driving for printers is the picking routine used to separate the media sheets of a Z-fold media stack, often used to print banners. In this banner pick routine, the backwards drive motion is used merely to separate the media sheets prior to picking, not to determine the location of the trailing edge of the media, and not to determine the media size. Desktop inkjet printers using this banner pick routine include the DeskJet® 682C and 693C model printers, produced by the Hewlett-Packard Company of Palo Alto, Calif., the present assignee.

Both the reflective photodiode and capacitive sensor methods rely on the position of the carriage to determine the media width. Commonly, carriage position sensing is accomplished using a quadrature optical encoder, although other devices, such as magnetic encoders, linear variable differential transformers, and cable-driven rotary potentiometers have also been used. All of these methods typically achieve a resolution of better than 0.2 millimeters (mm). In a similar manner, media length determination relies on the accuracy of the feed roller position sensor. This sensor is typically a rotary quadrature optical encoder device mounted on the roller drive motor. Rotary quadrature optical encoders normally achieve a resolution similar to that of the carriage position sensors.

Unfortunately, both the retroflective and capacitive sensing techniques require mounting the sensor on the printhead carriage. The extra mass of the sensors, along with that of the associated mounting hardware, must be continually carried by the carriage during operation. This additional weight requires a heavier-duty bearing design, draws greater power from the carriage servo system during use, and may decrease throughput (pages per minute) because the more massive carriage requires more time to reverse directions. Furthermore, additional flexible signal cabling and connections must also be made to the carriage, beyond those required to communicate with the inkjet cartridges for printing. Moreover, mounting these sensors on the printhead carriage requires the carriage to be wider, which then results in the overall product being wider, which increases the footprint of the printer, that is, the desktop workspace space required to house the printer. A larger printer footprint is undesirable to many consumers who require a compact inkjet printing mechanism. Thus, these carriage mounted sensors are inherently expensive, both in terms of direct cost and indirect costs or detriments to most consumers.

Additionally, these earlier retroflective and capacitive sensors are themselves relatively expensive. Various trade-offs typically need to be made between the resolution of the sensors and their expense, although these trade-offs are limited because these sensors must detect the media edges bi-directionally, first when traveling to the left then when traveling to the right. While less expensive sensors could be used, they typically suffer greater hysteresis effects, so accuracy is limited. Furthermore, the less expensive sensors have increasingly small focal distances, so the sensor face must be held very close to the media. Such a small media-to-sensor spacing limits the design margin available for producing economical printers for the home and small business environments.

Finally, since most desktop inkjet printers drive the media only unilaterally forward through the print zone, the length detection technique used in plotters cannot be employed. Furthermore, many printers sold into the home and small business markets have the media driven on an open-loop control system, without any feedback regarding the position of the media drive roller. Thus, typical home printers are incapable of media length detection, although a need for media length size detection, as well as media width detection, clearly exists in both home and small business inkjet printer markets.

SUMMARY OF THE INVENTION

According to one aspect of the invention, a media size sensing system is provided for determining the size of media supplied to an inkjet printing mechanism. The sensing system includes a power supply, and a media input member that receives media supplied to the inkjet printing mechanism. The media is typically rectangular, having an edge that is orthogonal (perpendicular) to a dimension of the media. The sensing system also has an energized strip supported by the media input member. The energized strip is electrically coupled between the power supply and an electrically neutral ground potential, which serves to energize the strip during use. The sensing system further includes a size adjuster slideably mounted to the media input member to contact the edge of media received by the input member. A sliding conductor is supported by the size adjuster and electrically coupled to the energized strip at a location which varies a resistance of the energized strip according to the magnitude of the dimension of media. A controller is coupled to the sliding conductor to determine the dimension of the media in response to the resistance of the energized strip when the size adjuster contacts the media edge.

According to another aspect of the invention, an inkjet printing mechanism may be provided with such a media size sensing system for determining the size of media loaded into the printing mechanism.

According to still another aspect of the invention, a method is provided for determining the size of media loaded into an input member of an inkjet printing mechanism, with the media having a first dimension and a first edge orthogonal (perpendicular) to this dimension. The method includes the step of energizing a strip of a conductive material supported by the input member. In a monitoring step, an electrical value set by the location of a size adjuster contacting the first edge of media loaded into the input member is monitored. The size adjuster is slideably supported by the input member. The size adjuster has a sliding conductor in electrical contact with the energized strip. The monitored electrical value is dependent upon the location of the sliding conductor along the energized strip. In a correlating step, the monitored electrical value is correlated with a dimension value selected from a group of known electrical values each corresponding to a media dimension. Finally, in an issuing step, an output signal is issued, with this output signal being indicative of the correlated dimension value selected for the media first dimension.

An overall goal of present invention is to provide a media size sensing system and a method for determining what size of media has been loaded into the input of an inkjet printing mechanism, and to provide a warning to an operator if the size of the loaded media does not match the size of the media selected for a particular print job.

A further goal of present invention is to provide an inkjet printing mechanism capable of determining what size of media has been loaded into the input, particularly for use in a home or small business desktop, or networked, computer environment.

An additional goal of the present invention is to provide an economical inkjet printing mechanism with a compact size having a small "footprint," which occupies minimal desktop workspace.

DETAILED DESCRIPTION OF A PREFERRED EMBODIMENT

Figure 1:
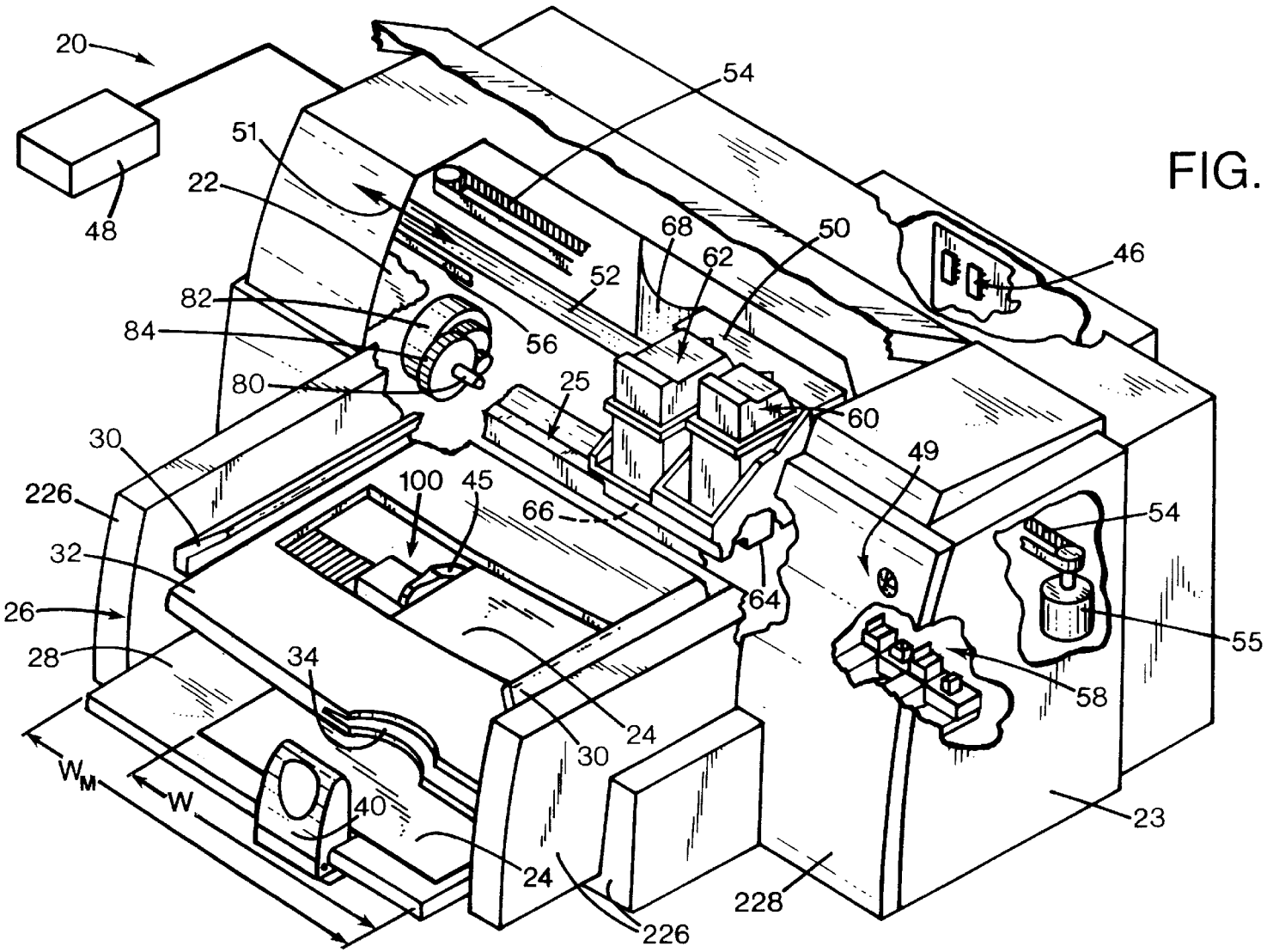
FIG. 1 is a fragmented perspective view of one form of an inkjet printing mechanism, here an inkjet printer, including one form of a media size detection system of the present invention.

FIG. 1 illustrates an embodiment of an inkjet printing mechanism, here shown as an inkjet printer 20, constructed in accordance with the present invention, which may be used for printing for business reports, correspondence, desktop publishing, artwork, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model. the typical inkjet printer 20 includes a chassis 22 surrounded by a housing or casing enclosure 23, typically of a plastic material. Sheets of print media 24 are fed through a printzone 25 by a print media handling system 26. The print media 24 may be any type of suitable sheet material, such as paper, card-stock, envelopes, fabric, transparencies, mylar, and the like, but for convenience, the illustrated embodiment is described using paper as the print medium. The print media handling system 26 has a media input, such as a feed tray 28 into which a supply of media 24 is loaded and stored before printing. A series of motor-driven paper drive rollers described in detail below (item number 70 in FIGS. 2–3) may be used to move the print media 24 from tray 28 into the printzone 25 for printing. After printing, the media sheet 24 then lands on a pair of retractable output drying wing members 30, shown extended to receive the printed sheet 24. The wings 30 momentarily hold the newly printed sheet 24 above any previously printed sheets (not shown) still drying in an output tray portion 32 before retracting to the sides to drop the newly printed sheet 24 into the output tray 32. The media handling system 26 may include a series of adjustment mechanisms for accommodating different sizes of print media 24, including letter, legal, A-4, envelopes, etc., such as an optional envelope feed slot 34. To secure the generally rectangular media sheet 24 in a lengthwise direction along the media length, the handling system 26 includes a sliding length adjustment lever 40, and to secure the media sheet 24 in a width direction W across the media width, the media handling system 26 includes a sliding width adjustment lever 45. The upper surface of the output tray 32 may have a series of icons attached to it, or molded into it, adjacent the path of the width adjustment lever 45, with each icon indicating a standard media width to which the lever 45 may be adjusted.

The printer 20 also has a printer controller, illustrated schematically as a microprocessor 46, that receives instructions from a host device, typically a computer, such as a personal computer 48. Indeed, many of the printer controller functions may be performed by the host computer, by the electronics on board the printer, or by interactions therebetween. As used herein, the term "printer controller 46" encompasses these functions, whether performed by the host computer, the printer, an intermediary device therebetween, or by a combined interaction of such elements. The printer controller 46 may also operate in response to user inputs provided through a key pad 49 located on the exterior of the casing 23. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A inkjet printhead carriage 50 is slideably supported for reciprocal movement along a scan axis 51 for travel back and forth across the printzone 25 by a guide rod 52. The carriage 50 is driven by a carriage propulsion system, here shown as including an endless belt 54 coupled to a carriage drive DC motor 55. The carriage propulsion system may also have a position feedback system, such as a conventional optical encoder system, which communicates carriage position signals to the controller 46. For instance, an optical encoder reader may be mounted to carriage 50 to read an encoder strip 56 extending along the path of carriage travel. The carriage drive motor 55 then operates in response to control signals received from the printer controller 46. One suitable carriage system is shown in U.S. Pat. No. 4,907,018, assigned to the present assignee, the Hewlett-Packard Company.

The carriage 50 is also propelled along guide rod 52 into a servicing region, located within the interior of the casing 23, which may house a conventional service station 58 that provides various conventional printhead servicing functions as described in the Background section above. A variety of different mechanisms may be used to selectively bring printhead caps, wipers and primers (if used) into contact with the printheads, such as translating or rotary devices, which may be motor driven, or operated through engagement with the carriage 50. For instance, suitable translating or floating sled types of service station operating mechanisms are shown in U.S. Pat. Nos. 4,853,717 and 5,155,497, both assigned to the present assignee, Hewlett-Packard Company. A rotary type of servicing mechanism is commercially available in the DeskJet® 850C, 855C, 820C and 870C color inkjet printers, sold by the Hewlett-Packard Company. A translational type of servicing mechanism, similar to that illustrated in FIG. 1, is commercially available in the DeskJet® 690C and 693C color inkjet printers, also sold by the Hewlett-Packard Company.

In the printzone 25, the media sheet receives ink from an inkjet cartridge, such as a black ink cartridge 60 and/or a color ink cartridge 62. The cartridges 60 and 62 are also often called "pens" by those in the art. The illustrated color pen 62 is a tri-color pen, although in some embodiments, a set of discrete monochrome pens may be used. While the color pen 62 may contain a pigment based ink, for the purposes of illustration, pen 62 is described as containing three dye based ink colors, such as cyan, yellow and magenta. The black ink pen 60 is illustrated herein as containing a pigment based ink. It is apparent that other types of inks may also be used in pens 60, 62, such as paraffin based inks, as well as hybrid or composite inks having both dye and pigment characteristics.

The illustrated pens 60, 62 each include reservoirs for storing a supply of ink. The pens 60, 62 have printheads 64, 66 respectively, each of which has an orifice plate with a plurality of nozzles formed therethrough in a manner well known to those skilled in the art. The illustrated printheads 64, 66 are thermal inkjet printheads, although other types of printheads may be used, such as piezoelectric printheads. The printheads 64, 66 typically include a substrate layer having a plurality of resistors which are associated with the nozzles. Upon energizing a selected resistor, a bubble of gas is formed to eject a droplet of ink from the nozzle onto the media in the printzone 25. The printhead resistors are selectively energized in response to enabling or firing command control signals, which may be delivered by a conventional multi-conductor strip 68 from the controller 46 to the printhead carriage 50, and through conventional interconnects between the carriage and pens 60, 62 to the printheads 64, 66.

Figure 2:
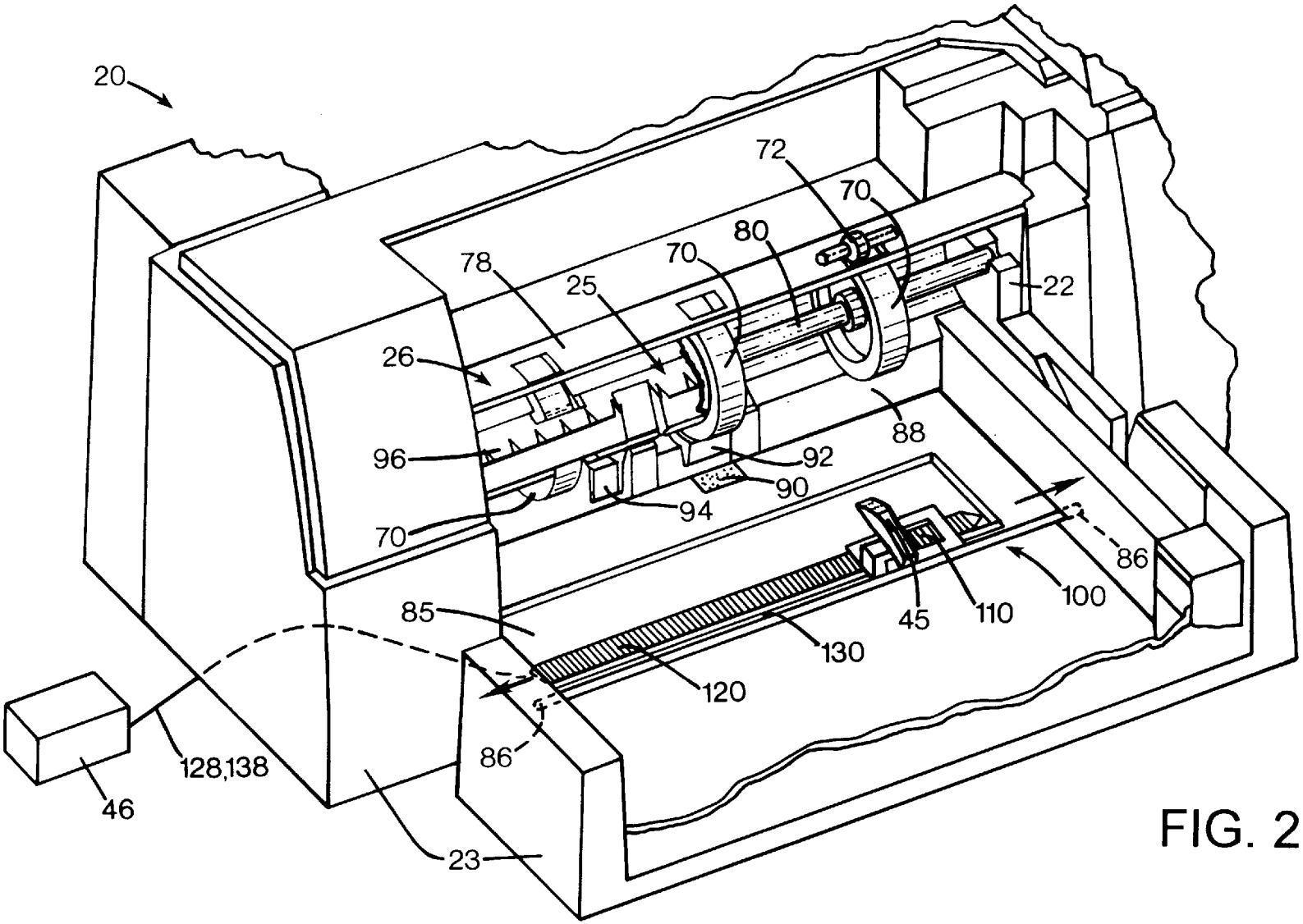
FIG. 2 is a partially schematic, fragmented, perspective view of a portion of the media handling system of FIG. 1.
Figure 3:
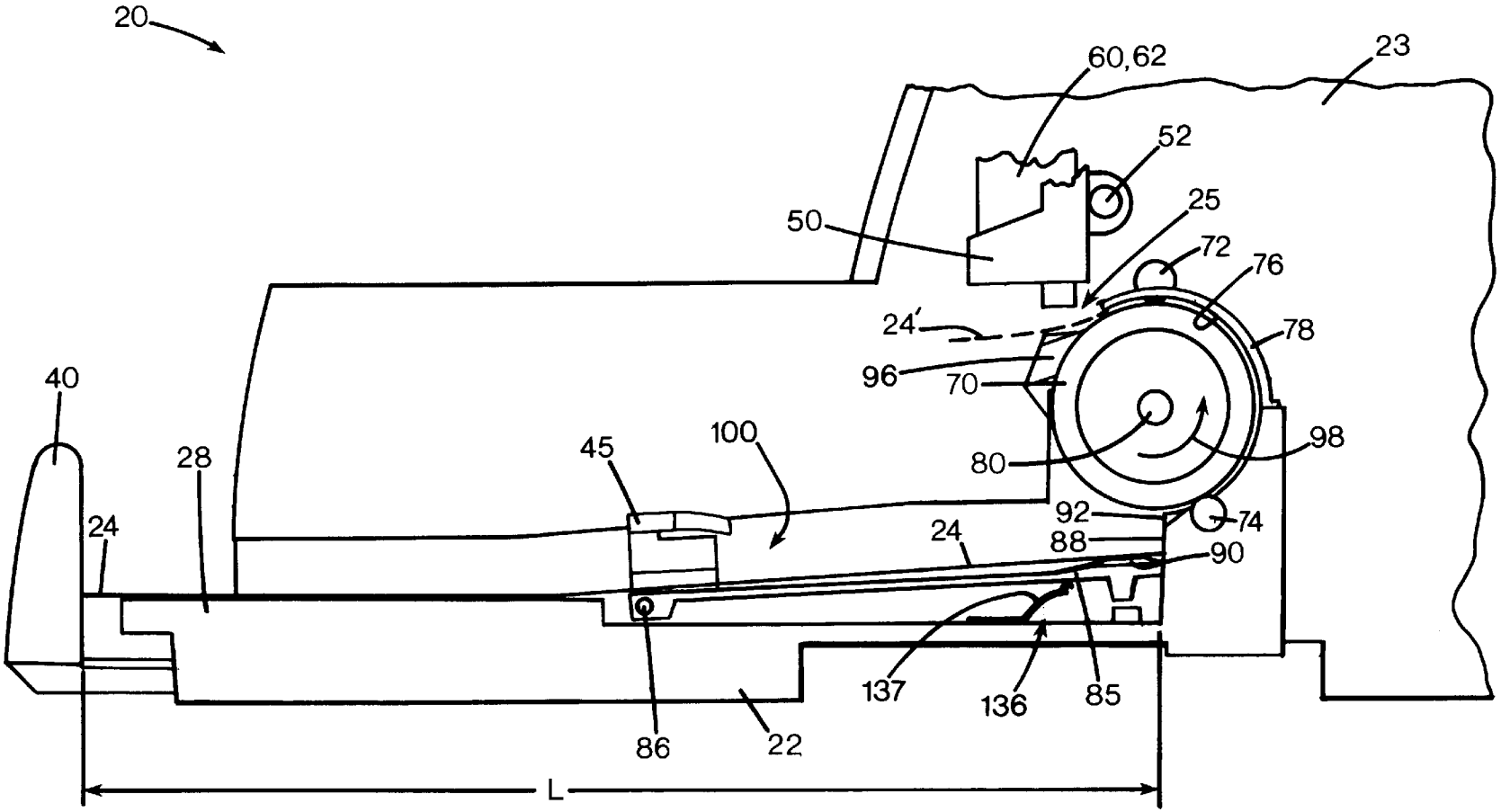
FIG. 3 is a side elevational view of the feed tray and drive roller assembly of the media handling of FIG. 1.

In FIGS. 2 and 3, the media handling system 26 is shown as including a drive roller, which may be a single roller or several discrete rollers, preferably three or four drive rollers or tires 70. Sets of upper and lower pinch rollers 72, 74 are located adjacent to each of the drive rollers 70 to assist in moving media from the input tray 28 to the printzone 25 along a media feed path 76, which is defined between the drive rollers 70 and a media guide 78. For clarity, only one of the upper pinch rollers 72 is shown in FIG. 2. The upper pinch rollers 72 assist to guide the media downwardly into the printzone 25, as indicated by the dashed line 24' in FIG. 3. The drive rollers 70 may be mounted along a common shaft 80, which may be coupled to a conventional drive motor, such as a stepper motor 82 by a conventional gear assembly 84 (see FIG. 1). In response to instructions received from the controller 46 via a control signal, the stepper motor 82 incrementally advances the drive rollers 70 to pull a sheet of media into the printzone 25 where it receives ink selectively ejected from pens 60, 62. Each incremental advance of the drive motor 82 is referred to in the art as a "step."

Figure 4:
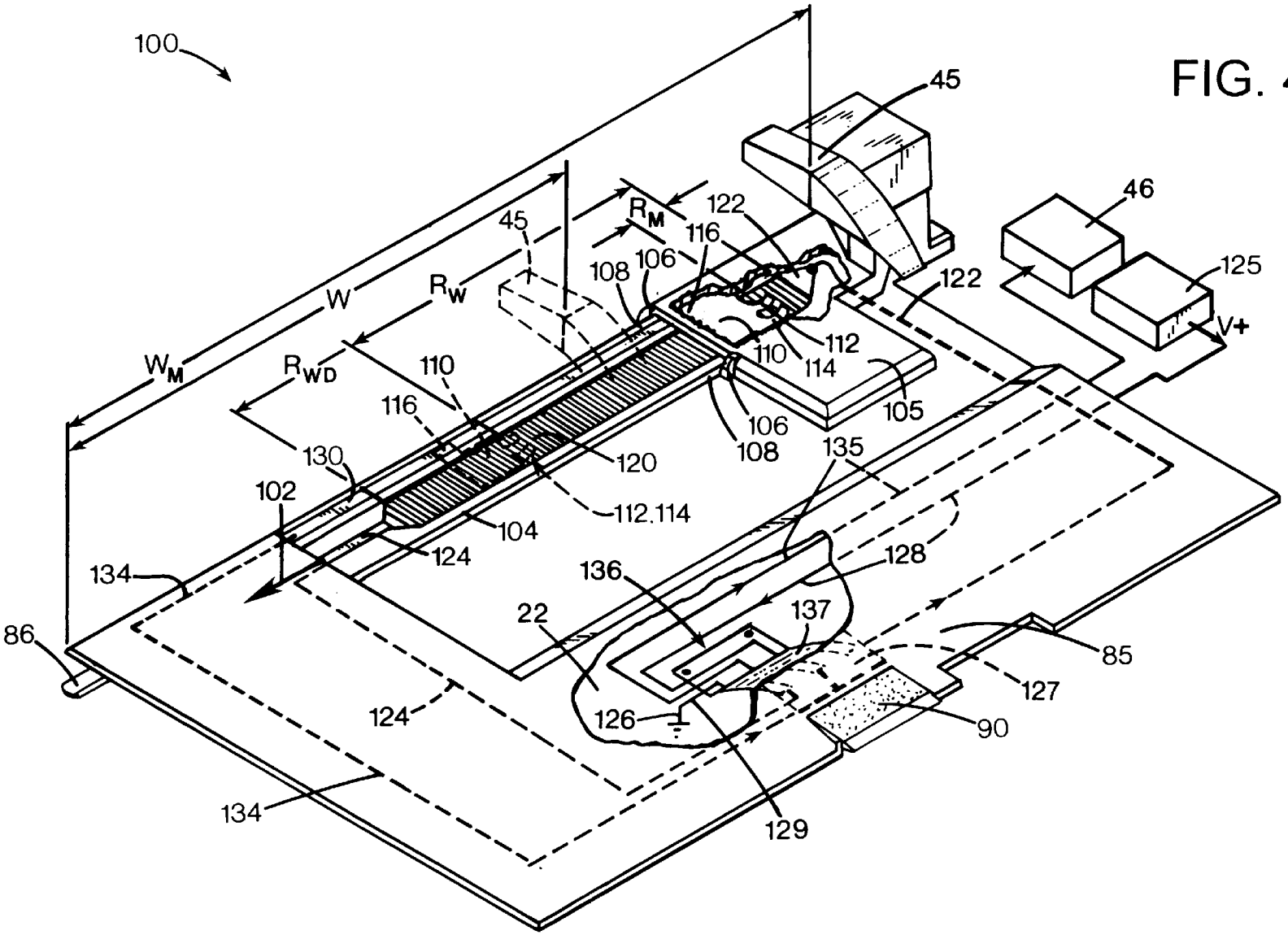
FIG. 4 is a perspective, partially schematic, view of one form of a media size detection system of FIG. 1, here, a width detection system.

As best shown in FIG. 4, the media handling system 26 includes a raiseable pressure or lift plate 85. The pressure plate 85 lays along a portion of the underside of the input tray 28, and is pivoted to the chassis 22 at a pair of pivot attachment points, such as pivot 86. Typically, a stack of media 24 is loaded into the printer 20 to overlay the pressure plate 85 until the leading edge of the stack is in contact with a loading wall 88, shown in FIGS. 2 and 3. The pressure plate 85 carries a friction member, such as a cork pad 90 located along an upper surface of the plate 85, adjacent the loading wall 88. A second friction member, here, a friction separator pad 92, is mounted on the chassis 22 along a portion of the loading wall 88, preferably adjacent to a conventional kicker member 94. The kicker 94 normally is spring-biased into a kicking position, which is also the rest state of the kicker. As a sheet of media passes over kicker 94 from the feed tray 28 to the printzone 25, the kicker spring (not shown) is stressed and the kicker is pushed into a feed position within a recess defined in the loading wall 88. The kicker 94 is shown pivoted outwardly in FIG. 2 into the kicking position to push the loaded media back into the input tray 28.

In operation, the media feed path 76 begins at the input tray 28 where the pressure plate 85 raises (from the rest position in FIG. 3) to bring a single sheet of cut media into contact with the drive rollers 70. The drive rollers 70 then pull this single sheet of media (or a single envelope) between the drive rollers 70 and lower pinch rollers 74, under the upper pinch rollers 72, then downwardly as indicated by dashed line 24' into the printzone 25. In the printzone 25, the media sheet is supported by a media support member, such as a platen member or pivot assembly 96, preferably with a reverse-bowed concave tensioning between the pinch rollers 72 and the pivot 96, which provides a desired printhead to media spacing between the printheads 64, 66 and the sheet of media in the printzone 25.

After each pass of the carriage 50 across the printzone 25, the media is then advanced by continuing to turn the drive rollers 70 in a forward or loading direction, indicated by curved arrow 98 in FIG. 3. The media sheet 24 is incrementally advanced through the printzone 25 until the entire image has been printed through consecutive passes of the printheads 64, 66 over the media. Upon completion of the print job, the printed sheet is ejected onto the output wings 30, where it dries momentarily before being lowered onto the output tray 32. When printing on a series of sheets, the kicker 94 is activated between sheets, as well as after the trailing edge of the last sheet passes over the kicker. Typically the body of the sheet of media, between the leading and trailing edges, holds the kicker in the feed position within its storage recess in the loading wall 88. When the trailing edge passes over the kicker, the kicker is released to travel to the kicking position. When released, the kicker 94 rotates out of its storage recess and pushes the remainder of the media stack back into the input tray 28 to prevent a multiple pick.

Resistive Media Size Detection System

FIG. 2 illustrates one form of a resistive media size sensing system 100, constructed in accordance with the present invention, here for determining the media width, dimension W in FIG. 1. The width adjuster 45 moves back and forth along a width adjust axis 102 of the pressure plate 85, for instance, from the widest, maximum dimension WM to a smaller dimension media sheet W, as shown in the dashed line position for the width adjuster 45 in FIG. 4. A series of ridges 104 are formed in the pressure plate 85 perpendicular to the width adjust axis 102. The width adjuster 45 includes a base 105 and a pair of sliding rails 106 which slidably engage a pair of tracks to along the pressure plate 85, preferably adjacent each side of the ridged portion 104.

A conductive multi-fingered slide contact member 110 is also secured to the adjuster base 105. The slide contact 110 preferably includes plural sliding contact members, such as the illustrated pair of fingers 112, 114 which are bowed downwardly to engage the ridges and grooves 104 as the width adjuster 45 is moved along the width of the pressure plate 85. The slide contact 110 also includes a third sliding contact member, here an output contact 116, which extends to a region beyond the ridged section 104. The slide contact 110 may be constructed of a conductive material with spring-like properties, such as beryllium copper, which provides a positive contact to the ridged region 104 as the width adjuster 45 is moved back and forth across the pressure plate 85. The use of the multiple fingers 112, 114 provides more positive contact with the ridged section 104, and conducts current more evenly as described further below. The alternating series of ridges and grooves 104 assists in providing a tactile feedback to an operator moving the width adjuster 45, as well as providing a manner of securing the width adjuster into a snug position against the edge of the media 24.

An energized conductive strip 120 overlies the ridged section 104 on the pressure plate 85. This conductive strip 120 may be a metallic strip or some other conductive material. In the preferred embodiment, the energized strip 120 may be constructed of either a conductive paint or a conductive film. Conductive paints and conductive films are economical materials which may be easily applied to the plate 85 to reduce labor costs associated with manufacturing the printer 20. Moreover, the use of a conductive paint or film does not add excessive weight to the printer, and conductive paints may be color matched to other portions of the printer casing 23. One suitable example of an ABS (acrylonitrile-butadiene-styrene) conductive static paint is sold under the trademark Staticpaint® by Antistatic Industries, Inc. of Hackensack, N.J. A suitable type of conductive film is a carbon-filled polyethylene film, manufactured by Roechling Engineered Plastics of Gastonia, N.C., which is available from Goodfellow, Inc. of Berwyn, Pa. In a preferred embodiment, the conductive film has a volume resistivity on the order of $10^7$–$10^9$ micro-ohm—centimeters. This conductive film may be bonded to the ridged section 104, for instance using a double-sided adhesive tape, a glue or other bonding agents.

To provide a current path across the energized strip 120, preferably the pressure plate 85 carries a conductor or lead wire electrically coupled either to the conductive paint or the conductive film of strip 120. In the preferred embodiment, a pair of plated traces 122, 124 are used to couple the energized strip 120 to a power supply 125 via strip 122, and to an electrically neutral ground point 126 via trace 124. The power supply 125 may originate from the printer controller 46. Preferably, the traces 122, 124 are of a conductive material, such as of a copper-tin compound or a nickel-based compound with a volume resistivity of less than 40 micro-ohm—centimeters, making electrical contact at opposing ends of the energized strip 120. To couple the trace 122 to the power supply 125, and trace 124 to the ground point 126, the traces 122, 124 may be routed across the undersurface of the pressure plate 85, as indicated schematically by dashed lines in FIG. 4. The traces 122, 124 may be coupled to two electrically insulated portions of an exposed soldered tab assembly 127, which is preferably located on the undersurface and along a rear edge of the pressure plate 85. As described further below with respect to FIG. 5, the exposed soldered tab assembly 127 may be used to couple trace 122 to a conductor 128 which receives power from supply 125, and to couple trace 124 to the ground point 126 via another conductor 129.

Figure 6:
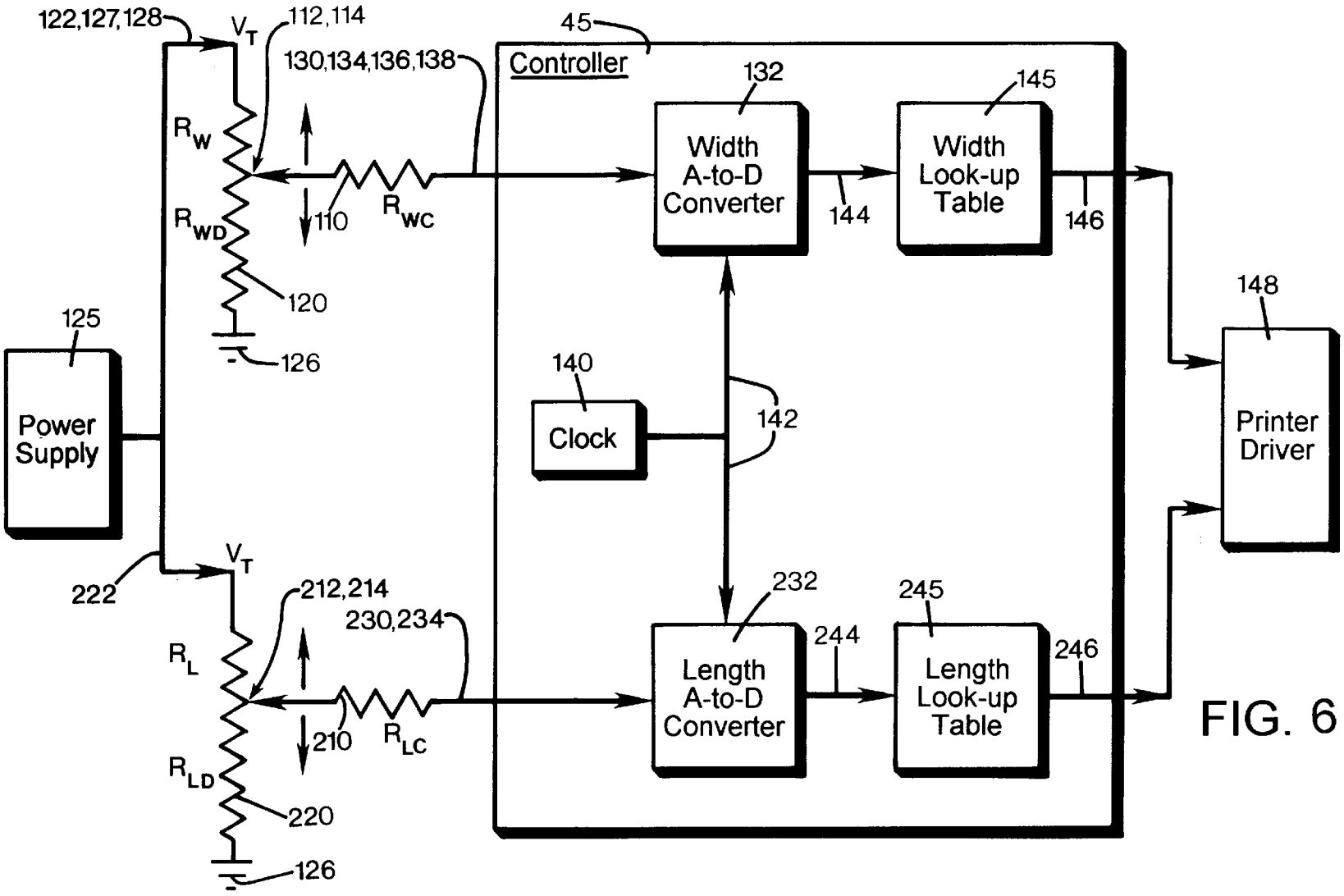
FIG. 6 is a block diagram illustrating one manner of operating the media size detection system of FIG. 1.

As the width adjuster 45 is translated across the pressure plate 85, the location of the slide contact fingers 112, 114 along the energized strip 120 serves as a voltage divider, with the output being taken using the output portion 116 of the slide contact 110. The output contact 116 rides along another conductive strip 130, which runs substantially parallel with the width adjust axis 102. The output strip 130 may be constructed of any of the same materials described above for the plated traces 122 and 124, and thus, output strip 130 has a volume resistivity which is preferably less than 40 micro-ohm—centimeters. The output conductor 130 is preferably coupled to a decoder portion of the printer controller 46, such as width dimension, analog-to-digital (A-to-D) converter 132, as shown in FIG. 6.

Preferably, the electrical connection between the onboard printed circuit assembly of controller 46 and the output conductor 130 is made by coupling a plated trace 134 to the output conductor 130, then routing the plated trace 134 across the undersurface of the pressure plate 85, as indicated schematically by dashed lines in FIG. 4. The output plated trace 134 may be constructed of the same materials as described above for the traces 122, 124. The output trace 134 is preferably coupled to a third portion of the soldered tab assembly 127 along the rear edge of the pressure plate 85. As described below with respect to FIG. 5, the soldered tab assembly 127 then couples the trace 134 to a conductor 135 which transmits information to controller 46.

Figure 5:
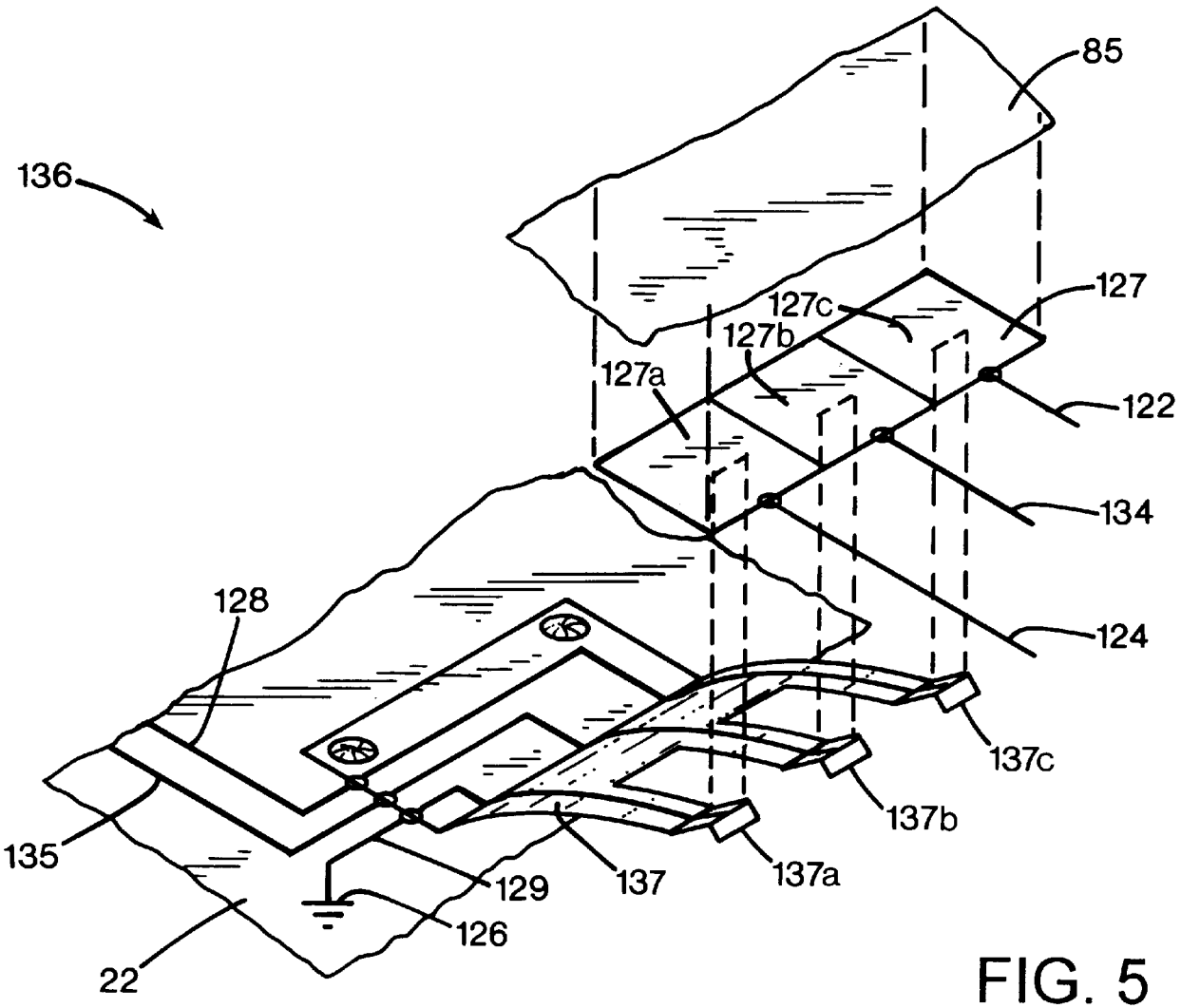
FIG. 5 is an enlarged perspective, partially schematic, view of a portion of FIG. 4, showing one manner of electrically coupling the sensor portion of the media size detection system to a power supply and controller portions of the system.

FIG. 5 shows one manner of coupling the electrical contacts on the pivoting pressure plate 85 to the controller 46, power supply 125 and electrical ground 126 which are supported by the chassis 22. In FIGS. 3 and 5, a spring contact assembly 136 is shown supported by the chassis 22 underneath the pressure plate 85. The solder tab assembly 127 has three regions 127*a*, 127*b* and 127*c*, which are electrically insulated from one another, and electrically coupled to traces 124, 134 and 122, respectively. The spring contact assembly 136 has three fingers 137*a*, 137*b* and 137*c*, which are electrically insulated from one another, and electrically coupled to traces 129, 135 and 128, respectively. The three fingers 137*a*, 137*b*, 137*c* may be constructed of the same spring-like conductive material as described above for the sliding contact 110. The leaf-spring characteristic of fingers 137*a*, 137*b*, 137*c* allows them to flex as the pressure plate is raised and lowered during the media picking and feeding process, so the fingers 137*a*–137*c* may remain in electrical contact with the respective pads 127*a*–127*c* of the tab assembly 127.

Thus, the current path to the A-to-D converter 132 begins at the power supply 125, proceeds through the plated trace 122 to the energized strip 120, through the sliding contact fingers 112, 114, then through the sliding output contact 116 to the output conductive strip 130, then through the plated trace 134 to tab 127*b* and spring finger 137*b*, then through conductor 135 to the A-to-D converter 132 of the controller 46. The resistance seen over the portion of this current path from the power supply 125 through the energized strip 120 up to the location of the sliding contact fingers 112, 114 is indicated as resistance RW in FIGS. 4 and 6 (with "R" for resistance, and "W" for width). The resistance experienced along the energized strip 120 varies with length of the current path along strip 120, which varies with the location of the slide contact 110, set by the position of the width adjuster 45 against the edge of the media. Thus, this variance in the resistance RW may be used to interpret the media width. FIG. 4 shows the adjuster 45 in a position corresponding to the maximum media width, dimension WM, with the resistance along the energized strip 120 being shown as RM (with "M" for maximum width, which actually corresponds to the minimum resistance along strip 120 experienced by the current path to converter 132).

Of course, the total resistance of the current path to the controller 46 also includes the resistances of the slide contact 110 (including the input fingers 112, 114 and the output contact 116), the output strip 130, the plated traces 134, the connectors 127*b*, 137*b* and the conductor 135. Except for the resistance of the output strip 130, these values are substantially constant and can be easily factored into the evaluation made by controller 46. These substantially constant resistance values are labeled as RWC in FIG. 6 (with "C" indicating a constant value). It is apparent that the length of the output strip 130 also changes with the position of slide contact 110, but this change in resistance may be accounted for along with the change in positional resistance of the slide contact 110 along the energized strip 120. That is, the positional resistance changes associated with the location of the slide contact 110 along both the energized strip 120 and the output strip 130 may both be considered to be represented by the variable resistance RW in FIG. 6, even though these variable resistances are at separate locations along the current path. As a practical matter, the change in resistance of the output strip 130 with respect to length is much, much less than the change in resistance with respect to length of the energized strip 120, due to the great differences in resistivity of the strips 120, 130. Recall, the volume resistivity of the energized strip 120 was preferably on the order of $10^7$–$10^9$ micro-ohm—centimeters, whereas the volume resistivity of the plated trace for the output strip 130 was preferably less than 40 micro-ohm—centimeters, which is over six orders of magnitude in difference. Thus, the contribution of the output strip 130 to the total resistance of the current path is nearly negligible in practice. A drain current path is formed along the balance of the energized strip 120 for any current not diverted through the slide contact 110 to the controller, with this drain current flowing through trace 124, conductors 127*a*, 137*a*, and through trace 129 to the electric grounding point 126, referred to in FIG. 6 as the resistance RWD (with "D" indicating drain).

Preferably, the total resistance of the energized strip 120 is selected from a range of 100,000–500,000 ohms, or more preferably, on the order of 200,000 (200 kilo-ohms), with the input impedance of the A-to-D converter 132 being on the order of one mega-ohm (1 MΩ). Selection of such a large resistance results in a relatively small continuous current draw from the power supply 125, which advantageously renders printer 20 more economical to operate. Furthermore, this relatively large resistance also minimizes the effect of the contact resistance variation between the traces 122, 124, 134, 135 and the controller 46, such as along the interface supplied by the solder tab assembly 127 and spring contact assembly 137, and conductors 128, 135, and between the slide contact 116 and strip 130. Additionally, the use of the multiple fingers 112, 114 for the slide contact 10 also reduces the effect of local contact resistance variation along the length of the energized strip 120.

The amount of voltage V+ applied by the power supply 125 to the energized strip 120 is preferably a small DC (direct current) voltage applied at trace 122, for example on the order of 3–20 volts. As an operator brings the width adjuster 45 into contact with the edge of the media 24, the slide contact 110 engages the energized strip 120 at various locations corresponding to the width of the media, which varies the resistance of the current path to converter 132. The power supply 125 generates a constant voltage to supply a small, steady stream of current to energize the strip 120. At the slide contact fingers 112, 114, this current stream splits, with the larger current following the path of least resistance. This is a phenomenon well known to those skilled in the art, and can be interpreted in terms of either the current levels or the voltage levels seen at the controller 46. Preferably, the A-to-D converter 132 interprets the voltage level, which is proportional to the proximity of the width adjuster 45 to one end or the other end of the energized strip 120. Since the speed at which the converter 132 determines the media width is not critical, an inexpensive A-to-D converter 132, such as an 8-bit (type ADC0803) or equivalent A-to-D converter, may be used to output a count value that varies in relation to the position of the width adjuster 45. A suitable A-to-D converter 132 may be supplied separately, or more advantageously contained within an application specific integrated circuit (ASIC) which is typically included with a conventional printed circuit assembly of the printer controller 46, onboard the printer 20.

Figure 7:
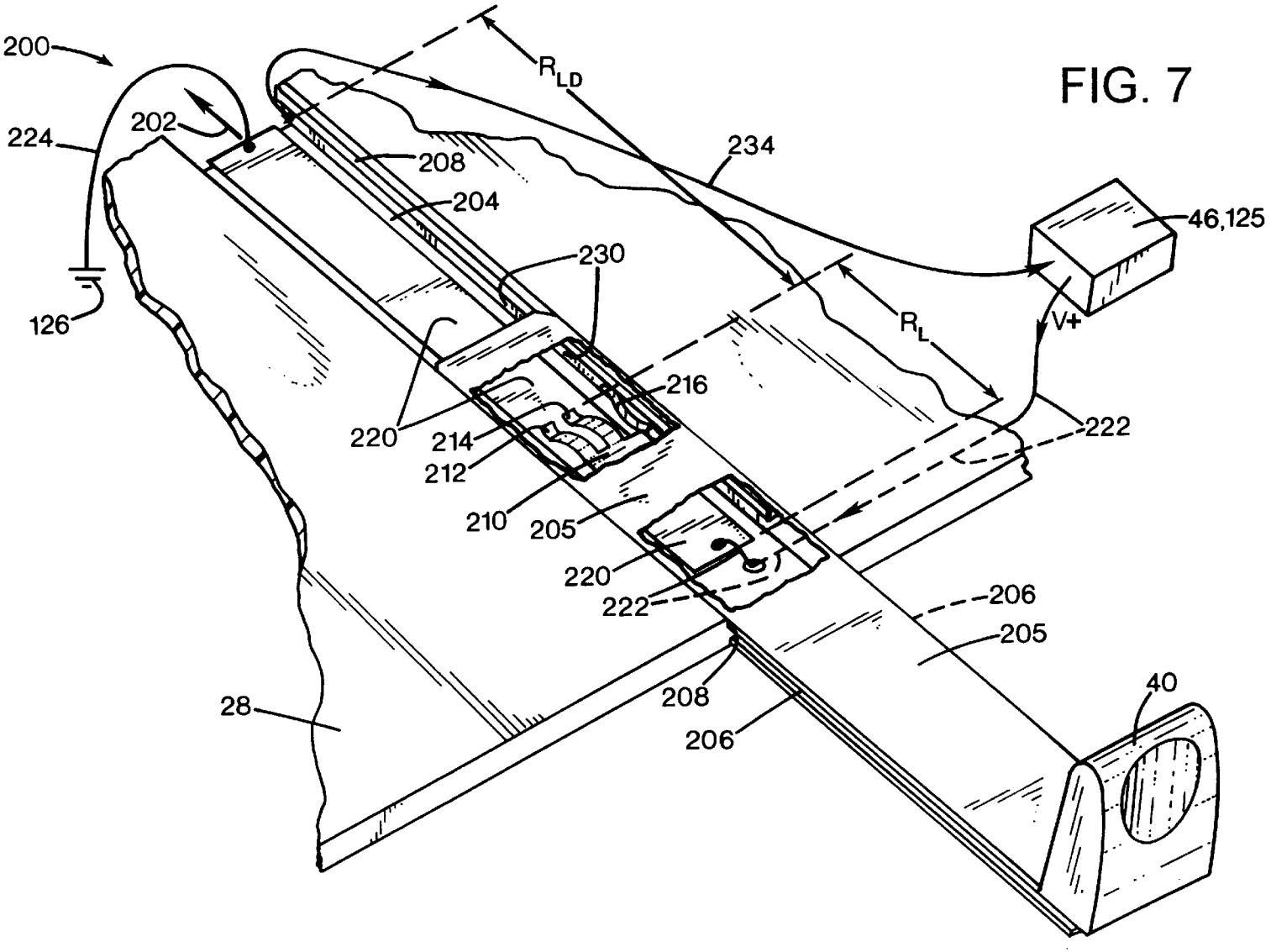
FIG. 7 is a perspective, partially schematic, view of one form of a media size detection system of FIG. 1, here, a length detection system.

As shown in FIG. 6 the controller 46 includes a clock 140, such as a 1 MHz clock, which supplies a clock signal 142 to the A-to-D converter 132. The clock 140 may be supplied as a separate, discrete component or onboard the ASIC of the controller 46. The A-to-D converter then produces a digital output signal 144 which is supplied to a width dimension look-up table 145. The look-up table 145 then correlates this digital output signal 144, which is dependent upon the position of the width adjuster 45, to determine the media width and provide a media width output signal 146. The width output signal 146 may be used by a printer driver portion 148 of the printer controller 46 to alert an operator as to what width of media is loaded in the input tray 28 of the printer 20. In particular, the printer driver 148 may alert an operator when the media size loaded does not match the media size specified in the next print job to be sent to the printer 20. The printer driver 148 may be software, firmware, hardware or various combinations thereof, included within the printer controller 46, within a portion of the host computer 48, or a combination thereof FIG. 7 illustrates a second portion of a media size sensing system 200 constructed in accordance with the present invention, here, for determining the media length, dimension L. Here, the variation in media length stems from the position of a slide contact applied to the paper length adjuster 40, in a similar fashion to that applied to the width adjuster 45 in FIG. 4. The length adjuster 40 moves back and forth along a length adjust axis 202 of the input tray 28 to accommodate different lengths of media, for instance the media sheet having dimension L in FIG. 3. The input tray 28 has a recess 204 formed therein perpendicular to the length adjust axis 202 to slideably receive the length adjuster 40. The length adjuster 40 includes a base 205 and a pair of tracks 206 adjacent each side of the base 205, with the tracks 206 slidably engaging a pair of rails 208 along the input tray 28.

A conductive multi-fingered slide contact member 210 is secured to the length adjuster base 205. The slide contact 210 preferably includes plural sliding contact members, such as the illustrated pair of fingers 212, 214 which are bowed downwardly to engage the bottom surface of the recess 204 as the length adjuster 40 is moved along the length of the input tray 28. The slide contact 210 also includes a third sliding contact member, here an output contact 216, which extends toward an upright wall portion of the recess 204. The slide contact 210 may be constructed as described above for the width adjuster slide contact 110. The recess 204 may be lined with a series of alternating ridges and grooves, such as described above for the ridged section 104 in FIG. 4, or the bottom surface of recess 204 may be relatively smooth as illustrated.

An energized conductive strip 220 overlies the bottom surface of recess 204 in the input tray 28. This conductive strip 220 may be constructed as described above for the width adjuster energized strip 120, for instance either of a conductive paint or a conductive film having a similar magnitude of resistance to achieve similar benefits. The manner of coupling the strip 220 between the power supply 125 and the ground point 126 may be as described above for strip 120, using plated traces, solder tabs and conductors. For example, a variety of different types of mating connectors may be used to couple the strip 220 to the power supply 125 and the ground 126, particularly if the input and output trays 28, 32, and their sidewalls 226 (FIG. 1) are removable from the balance of the printer chassis 22 and enclosure 23. For instance, one suitable type of connector may be constructed as described above for assembly 136 in FIG. 5. Since these concepts concerning plated traces, etc. have been fully developed above, and because a variety of equivalent coupling methods known to those skilled in the art may be substituted for those covered here, these electrical current paths are shown schematically in FIG. 7. The strip 220 is coupled to the power supply 125 by a conductor 222, and to the ground point 126 by a conductor 224. Here, the power supply 125 is illustrated as originating from the printer controller 46, and may be of the same voltage levels as applied to the width adjuster strip 120.

As the length adjuster 40 is translated across the input tray 28, the location of the slide contact fingers 212, 214 along the energized strip 220 serves as a voltage divider, as described above for strip 120 and slide contact 110. Here, the output contact 216 rides along another conductive strip 230, which runs substantially parallel with the length adjust axis 202, but preferably along an upright wall of the recess 204. The output strip 230 may be constructed any of the same materials described above for strips 120 and 130. The output strip 230 is preferably coupled to a decoder portion of the printer controller 46, such as length dimension A-to-D (analog-to-digital) converter 232 shown in FIG. 6, which may be of the same construction as the width converter 132. The electrical connection of strip 230 to the converter 232 may be made as described above with respect to strip 130 in FIG. 4, or the energized strips 120, 220, or by a variety of equivalent methods known to those skilled in the art. Thus, for simplicity, strip 230 is shown schematically as being coupled to the converter 232 by conductor 234.

Thus, the current path to the A-to-D converter 232 begins at the power supply 125, proceeds through the conductor 222 to the energized strip 220, through the sliding contact fingers 212, 214, then through the sliding output contact 216 to the output strip 230, then through conductor 234 to the A-to-D converter 232 of the controller 46. The resistance seen over the portion of this current path from the power supply 125 through the energized strip 220 up to the location of the sliding contact fingers 212, 214 is indicated as resistance RL in FIGS. 6 and 7 (with "R" for resistance, and "L" for length), with the resistance seen by the drain current to ground being labeled as RLD (with "D" indicating drain). The substantially constant resistance values associated with the slide contact 210 and the conductors 222, 234 are labeled as RLC in FIG. 6 (with "C" indicating a constant value). The resistance experienced along strips 220 and 230 varies with the position of the length adjuster 40 against the edge of the media, and may be dealt with by the controller 46 as described above for strips 120, 130. Thus, this variance in the resistance RL may be used to interpret the media length.

The analog-to-digital (A-to-D) length converter 232 receives the clock signal 142 from clock 140, as well as the information from the output strip 230, and in response thereto, supplies a digital signal 244 to a length look-up table 245, preferably in the same manner as described fro the width converter 132. The length look-up table 245 may function as described above for table 145, but here to provide a length output signal 246 to the printer driver 148. The printer driver 148 may then communicate this length information via the host computer 48 to an operator as to whether correct media 24 for the upcoming print job has been loaded into the input tray 28, and to provide a warning if not.

Conclusion

Advantageously, the illustrated resistive media size detection systems 100 and 200 have no components mounted on the printhead carriage 50. Thus, the systems 100, 200 add no additional mass to the carriage 50, nor does their use alter the overall width or footprint of the printer 20. Furthermore, these systems may be implemented into current printer products with very little impact on the overall printer design.

If the use of only standard sized media is contemplated, only one of the systems 100, 200 may be supplied with the printer 20. However if the width detect system 100 and the length detect system 200 are used together, they may advantageously serve as a cross check for each other when encountering standard sized media or for detecting the presence of non-standard, custom-sized media. Furthermore, when functioning together as a cross check, the systems 100, 200 may also serve to alert an operator as to whether the length adjuster 40 and the width adjuster 45 are snugly resting against the edges of the media 24, which could assist in minimizing media mis-feeds. For instance, if the width detect system 100 interpreted the media width as being letter size, but the length detect system 200 interpreted the media length as being A-4 size, then the operator may be asked whether a non-standard media size was being used. If not, that is, if a standard letter sized media was loaded, the operator may be asked to push the length adjuster 40 inward to move leading, edge of the media into engagement with the loading wall 88 (FIG. 3) for a proper media pick by rollers 70.

The resistive media size detect systems 100, 200 take advantage of the long response time available after the customer positions the width adjuster 45 and the length adjuster 40 by using slower reacting, more economical A-to-D converters 132 and 232. The use of slower A-to-D converters 132, 232 has no bearing or detrimental effect on the printer throughput, which is typically a rating measured in pages-per-minute to rate printer efficiency. Thus, slow and relatively inexpensive A-to-D converters may be used to provide a more economical printer 20 for consumers without impacting printer performance.

Constructing the size sensors comprising the energized strips 120, 220 with a conductive film, such as a conductive polyethylene film with an adhesive backing, enables the sensors 100, 200 to be integrated with the pressure plate assembly 85 for the width conductor 120, or with the media input tray 28 for length conductor 220. Thus, the sensor function provided by the energized strips 120, 220 is relatively unobtrusive and nearly invisible to the consumer. Use of a conductive paint for the energized conductors 120, 220 advantageously has the benefit of being tinted to match the color of the printer casing 23, as well as the pressure plate 85 and the input tray 28. Use of the plated traces 122, 124, 128, 129, 134, 135 (FIG. 4) and the conductors 222, 224, 234 (FIG. 7) advantageously allows the electrical connection to the conductive strips 120, 130 and 220, 230 to be made when the conductive strips are applied to the pressure plate 85 and the input tray 26, respectively. For instance, the electrical connections between the plated traces and the conductive strips may be made by the physical contact that occurs as a consequence of the application of the conductive strip to the pressure plate 85 or the input tray 28, which have previously been plated with the traces. Thus, by overlaying the conductive strips 120, 220 onto a portion of the plated traces 122, 124, 134, no further secondary soldering or other process steps are required. Thus, making these electrical contacts at the time the conductive strips 120, 130, 220, 230 are applied further simplifies the assembly process and reduces the labor costs associated with manufacturing the printer 20.

Use of these resistive media size detect systems 100, 200 adds value to the printer product 20 at a relatively low additional cost by eliminating the use of cabled connectors and instead, in the preferred embodiment, using the plated traces 122, 124, 128, 129, 134, 135, 220, 224 and 234. The use of these plated traces is made possible due to the low current demand of the resistive sensor strips 120, 220. Use of these plated traces also reduces the cost associated with an alternative cabled connection system, which is also typically more error prone. Thus, use of the plated traces increases reliability while also eliminating a variety of time consuming assembly steps which would otherwise be required to electrically couple the sensors 120, 220 to the printer controller 46.

Finally, the low current and power requirements of the media size detection systems 100 and 200 makes them safe for use in operator-accessible locations of the printer 20. A further safety margin is also obtained by routing the plated traces along the undersurface of the pressure plate 85, a region which is relatively inaccessible to the operator. Furthermore, the multi-fingered slide contacts 110 and 210 are also made relatively inaccessible by positioning them underneath the width adjuster 45 and underneath the length adjuster 40.

I claim:

1. A media size sensing system for determining the size of media supplied to an inkjet printing mechanism, comprising:

a power supply;

a media input member that receives media supplied to the inkjet printing mechanism, with the media having an edge orthogonal to a dimension of the media, wherein the media input member has a contact surface area with a longitudinal axis, with the contact surface area comprising plural mutually parallel ridges which intersect the longitudinal axis;

an energized strip supported by the media input member and coupled between the power supply and an electrically neutral ground potential, wherein the energized strip is supported by the contact surface area to extend along the longitudinal axis and over the plural ridges;

a size adjuster slideably mounted to the media input member to contact the edge of media received by the input member;

a sliding conductor supported by the size adjuster and electrically coupled to the energized strip at a location which varies a resistance of the energized strip according to the magnitude of said dimension of media received by the input member, wherein the sliding conductor comprises a finger member biased into contact with the energized strip and biased to engage at least one of the plural ridges to secure the size adjuster against the media edge; and a controller coupled to the sliding conductor to determine said dimension of the media in response to the resistance of the energized strip when the size adjuster contacts the media edge.

2. A media size sensing system according to claim 1 wherein:

the media size sensing system further includes an output conductor that electrically couples the sliding conductor to the controller, with the output conductor having a segment supported by the media input member; and the sliding conductor is electrically coupled to said segment of output conductor.

3. A media size sensing system according to claim 1 wherein the energized strip comprises a conductive paint strip applied to the contact surface area.

4. A media size sensing system according to claim 3 wherein:

the media input member has an output surface area;

the media size sensing system further includes an output conductor having a segment comprising another conductive paint strip applied to the output surface area of the media input member, with the output conductor electrically coupling the sliding conductor to the controller; and the sliding conductor is electrically coupled to said segment of output conductor.

5. A media size sensing system according to claim 1 wherein the energized strip is of a carbon-filled electrically conductive film bonded to the contact surface area.

6. A media size sensing system according to claim 5 wherein:

the media size sensing system further includes an output conductor having a segment of a carbon-filled electrically conductive film bonded to the output surface area of the media input member, with the output conductor electrically coupling the sliding conductor to the controller; and the sliding conductor is electrically coupled to said segment of the output conductor.

7. A media size sensing system according to claim 1 wherein the sliding conductor comprises plural finger members biased into contact with the energized strip.

8. A media size sensing system according to claim 1 wherein:

said finger member comprises an input finger member;

the media size sensing system further includes an output conductor electrically coupled to the controller, with the output conductor having a segment supported by the media input member; and the sliding conductor further includes an output finger member biased into electrical contact with said segment of output conductor.

9. A media size sensing system according to claim 1 wherein:

the resistance of the energized strip comprises an analog value;

the controller includes an analog-to-digital converter device that converts the analog value of the energized strip resistance into a digital resistance value; and the controller further includes a correlation device that correlates the digital resistance value with known dimensions for said dimension of the media to provide a media dimension output signal.

10. A media size sensing system according to claim 1 wherein the maximum resistance of the energized strip is 100,000–500,000 ohms.

11. A media size sensing system according to claim 1 wherein:

said dimension of the media comprises a first dimension, said media edge comprises a first edge, said energized strip comprises a first energized strip, said size adjuster comprises a first size adjuster, said sliding conductor comprises a first sliding conductor;

the media supplied to the inkjet printing mechanism has a second edge orthogonal to a second dimension of the media which is orthogonal to the media first dimension;

the media size sensing system further includes:

(a) a second energized strip coupled between the power supply and the electrically neutral ground potential;

(b) a second size adjuster slideably mounted to the media input member to contact the second edge of media received by the input member; and (c) a second sliding conductor supported by the second size adjuster and electrically coupled to the second energized strip at a location which varies a resistance of the second energized strip according to the magnitude of the second dimension of media received by the input member; and the controller is also coupled to the second sliding conductor to determine second dimension of the media in response to the resistance of the second energized strip when the second size adjuster contacts the media second edge.

12. A media size sensing system according to claim 11 wherein:

the controller further includes a first correlation device that correlates the resistance of the first energized strip when the first size adjuster contacts the media first edge with known dimensions for the first dimension of the media to provide a first dimension output signal;

the controller further includes a second correlation device that correlates the resistance of the second energized strip when the second size adjuster contacts the media second edge with known dimensions for the second dimension of the media to provide a second dimension output signal; and the controller issues a signal to alert an operator when the first and second dimension output signals fail to correspond to known dimensions of standard size media which has a known first dimension and a corresponding known second dimension.

13. A media size sensing system according to claim 1 wherein the energized strip and the sliding conductor cooperate as a voltage divider, and the controller interprets said resistance of the energized strip when the size adjuster contacts the media edge in terms of a voltage signal received from the sliding conductor.

14. A method of determining the size of media loaded into an input member of an inkjet printing mechanism, with the media having a first dimension and a first edge orthogonal thereto, the method comprising the steps of:

providing the media input member with a contact surface area having a longitudinal axis, with the contact surface area comprising plural mutually parallel ridges which intersect the longitudinal axis;

energizing a strip of a conductive material supported by the input member, and supporting the energized strip with the contact surface area to extend along the longitudinal axis and over the plural ridges;

monitoring an electrical value set by the location of a size adjuster contacting the first edge of media loaded into the input member, with the size adjuster being slideably supported by the input member, with the size adjuster comprising a sliding conductor in electrical contact with the energized strip, and with said electrical value being dependent upon the location of the sliding conductor along the energized strip, wherein the sliding conductor comprises a finger member biased into contact with the energized strip and biased to engage at least one of the plural ridges to secure the size adjuster against the media edge;

correlating the monitored electrical value with a dimension value selected from a group of known electrical values each corresponding to a media dimension; and issuing an output signal indicative of the correlated dimension value selected for the media first dimension.

15. A method according to claim 14, further including the steps of:

determining the size of media selected for a print job to be printed by the inkjet printing mechanism;

comparing the correlated dimension value with the determined size of media to determine whether the correlated dimension value corresponds to a dimension of the determined size of media; and in response to the comparing step, when the correlated dimension value fails to correspond a dimension of the determined size of media, issuing an alert signal to alert an operator of the inkjet printing mechanism.

16. A method according to claim 15, further including the step of allowing an operator to print on the loaded media after receiving the alert signal.

17. A method according to claim 15, wherein the alert signal comprises a message instructing the operator to verify that the size adjuster is contacting the first edge of media loaded into the input member.

18. A method according to claim 14, for determining a second dimension of media loaded into the input member, with the media having a second edge orthogonal to the second dimension which is orthogonal to the media first dimension, further including the steps of:

energizing a second strip of a conductive material;

monitoring a second electrical value set by the location of a second size adjuster contacting the second edge of the loaded media, with the second size adjuster comprising a second sliding conductor in electrical contact with the second energized strip, and with said second electrical value being dependent upon the location of the second sliding conductor along the second energized strip;

correlating the monitored second electrical value with a second dimension value selected from a second group of known electrical values each corresponding to a media dimension; and issuing a second output signal indicative of the correlated second dimension value selected for the media second dimension.

19. A method according to claim 18, further including the steps of:

comparing the correlated dimension value, comprising a first correlated dimension value, with the correlated second dimension value to determine whether the first and second correlated dimension values correspond to dimensions for one of plural standard media sizes; and in response to the comparing step, when the first and second correlated dimension values fail to correspond to dimensions for one of the plural standard media sizes, issuing a signal to alert an operator of the inkjet printing mechanism.

20. An inkjet printing mechanism for printing on media, comprising:

a media input member that receives media having an edge orthogonal to a dimension of the media, wherein the media input member has a contact surface area with a longitudinal axis, with the contact surface area comprising plural mutually parallel ridges which intersect the longitudinal axis;

a media handling system that delivers media from the media input member to a printzone;

an inkjet printhead that selectively ejects ink to print on media in the printzone;

a power supply;

an energized strip supported by the media input member and coupled between the power supply and an electrically neutral ground potential, wherein the energized strip is supported by the contact surface area to extend along the longitudinal axis and over the plural ridges;

a size adjuster slideably mounted to the media input member to contact the edge of media received by the input member;

a sliding conductor supported by the size adjuster and electrically coupled to the energized strip at a location which varies a resistance of the energized strip according to the magnitude of said dimension of media received by the input member, wherein the sliding conductor comprises a finger member biased into contact with the energized strip and biased to engage at least one of the plural ridges to secure the size adjuster against the media edge; and a controller coupled to the sliding conductor to determine said dimension of the media in response to the resistance of the energized strip when the size adjuster contacts the media edge.

21. An inkjet printing mechanism according to claim 20 wherein the energized strip comprises a conductive paint strip applied to the contact surface area.

22. An inkjet printing mechanism according to claim 21 wherein the energized strip is of a carbon-filled electrically conductive film bonded to the contact surface area.

* * * * *

UNITED STATES PATENT AND TRADEMARK OFFICE

CERTIFICATE OF CORRECTION

PATENT NO : 5,940,106

DATED : August 17, 1999

INVENTOR(S) : Walker

It is certified that error appears in the above-identified patent and that said Letters Patent is hereby corrected as shown below:

IN THE SPECIFICATION

Column 3, (line 55), after "workspace" delete "space".
Column 4, (line 66), after "of" insert --the--.
Column 5, (line 5), after "of" insert --the--.
Column 11, (line 55), delete "10" and insert therefor --110--.
Column 12, (line 38), after "thereof" insert --.--.
Column 14, (line 5), delete "fro" and insert therefor --for--.
Column 14, (line 40), after "leading" delete ",".

IN THE CLAIMS

Column 18, (line 35), after "14" delete ",".
Column 20, (line 18), delete "claim 21" and insert therefor --claim 20--.

Signed and Sealed this

Second Day of May, 2000

*Attest:*

Q. TODD DICKINSON

*Attesting Officer*

*Director of Patents and Trademarks*